US009994295B2

(12) United States Patent
Mizutani

(10) Patent No.: US 9,994,295 B2
(45) Date of Patent: Jun. 12, 2018

(54) OUTBOARD MOTOR

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days. days.

(21) Appl. No.: 15/426,196

(22) Filed: Feb. 7, 2017

(65) Prior Publication Data

US 2017/0225759 A1 Aug. 10, 2017

(30) Foreign Application Priority Data

Feb. 8, 2016 (JP) ..... 2016-022115

(51) Int. Cl.

| | |
|---|---|
| ***B63H 20/32*** | (2006.01) |
| ***B63H 21/36*** | (2006.01) |
| ***B63H 20/10*** | (2006.01) |
| ***B63H 20/24*** | (2006.01) |
| ***F02M 35/16*** | (2006.01) |
| ***F02M 35/10*** | (2006.01) |

(52) U.S. Cl.

CPC ..... *B63H 20/10* (2013.01); *B63H 20/24* (2013.01); *B63H 20/32* (2013.01); *F02M 35/10301* (2013.01); *F02M 35/167* (2013.01); *B63B 2758/00* (2013.01); *B63H 2020/103* (2013.01)

(58) Field of Classification Search

CPC ..... B63H 20/10; B63H 20/24; B63H 20/32; B63H 2020/10; B63H 20/103; F02M 35/10301; F02M 35/167; B63B 2758/00

USPC ..... 440/53, 61 T, 76, 77

See application file for complete search history.

(56) References Cited

U.S. PATENT DOCUMENTS

| | | | | |
|---|---|---|---|---|
| 2,091,247 A * | 8/1937 | Williams, Jr. | ..... | B63H 20/02 440/53 |
| 2,676,559 A * | 4/1954 | Davies | ..... | B63H 20/10 123/195 P |
| 4,615,683 A * | 10/1986 | Harada | ..... | F02B 61/045 440/52 |
| 2013/0160695 A1 | 6/2013 | Gratz et al. | | |

FOREIGN PATENT DOCUMENTS

JP 2015-504813 A 2/2015

* cited by examiner

*Primary Examiner* — Daniel V Venne
(74) *Attorney, Agent, or Firm* — Keating and Bennett, LLP

(57) ABSTRACT

An outboard motor includes an engine, a cowl, and a tilt mechanism. The cowl accommodates the engine. The tilt mechanism pivots the cowl from a tilt-down position to a tilt-up position about a horizontal tilt axis. The cowl includes a movable portion that moves from a normal position to a contracted position to reduce a contour of the cowl when the cowl is pivoted from the tilt-down position to the tilt-up position by the tilt mechanism.

20 Claims, 10 Drawing Sheets

OUTBOARD MOTOR

CROSS REFERENCE TO RELATED APPLICATIONS

This application claims the benefit of priority to Japanese Patent Application No. 2016-022115 filed on Feb. 8, 2016. The entire contents of this application are hereby incorporated herein by reference.

BACKGROUND OF THE INVENTION

1. Field of the Invention

The present invention relates to an outboard motor.

2. Description of the Related Art

A type of watercraft equipped with an outboard motor attached to its hull has been known (see, e.g., Published Japanese Translation of PCT International Patent Application No. 2015-504813). The hull is provided with a rear wall to divide a deck space and a motor well in which the outboard motor is disposed. The outboard motor is attached to a transom provided in the motor well, and is capable of tilting up and down. When anchoring the watercraft, the outboard motor is tilted up in order to avoid the occurrence of galvanic corrosion and the attachment of algae.

To expand the deck space, it is effective to shift the rear wall rearward by reducing the size of the motor well. However, in a construction in which the rear wall is shifted rearward, the outboard motor inevitably interferes with the rear wall when located in a tilt-up position. This imposes limitations on the reduction in size of the motor well.

SUMMARY OF THE INVENTION

Preferred embodiments of the present invention provide an outboard motor including a reduced-size motor well of a watercraft hull.

An outboard motor according to a preferred embodiment of the present invention includes an engine, a cowl, and a tilt mechanism. The cowl accommodates the engine. The tilt mechanism pivots the cowl from a tilt-down position to a tilt-up position about a horizontal tilt axis. The cowl includes a movable portion. The movable portion is moved from a normal position to a contracted position so as to shrink or reduce a contour of the cowl when the cowl is pivoted from the tilt-down position to the tilt-up position by the tilt mechanism.

According to preferred embodiments of the present invention, it is possible to provide an outboard motor such that a motor well of a watercraft hull is able to be reduced in size.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
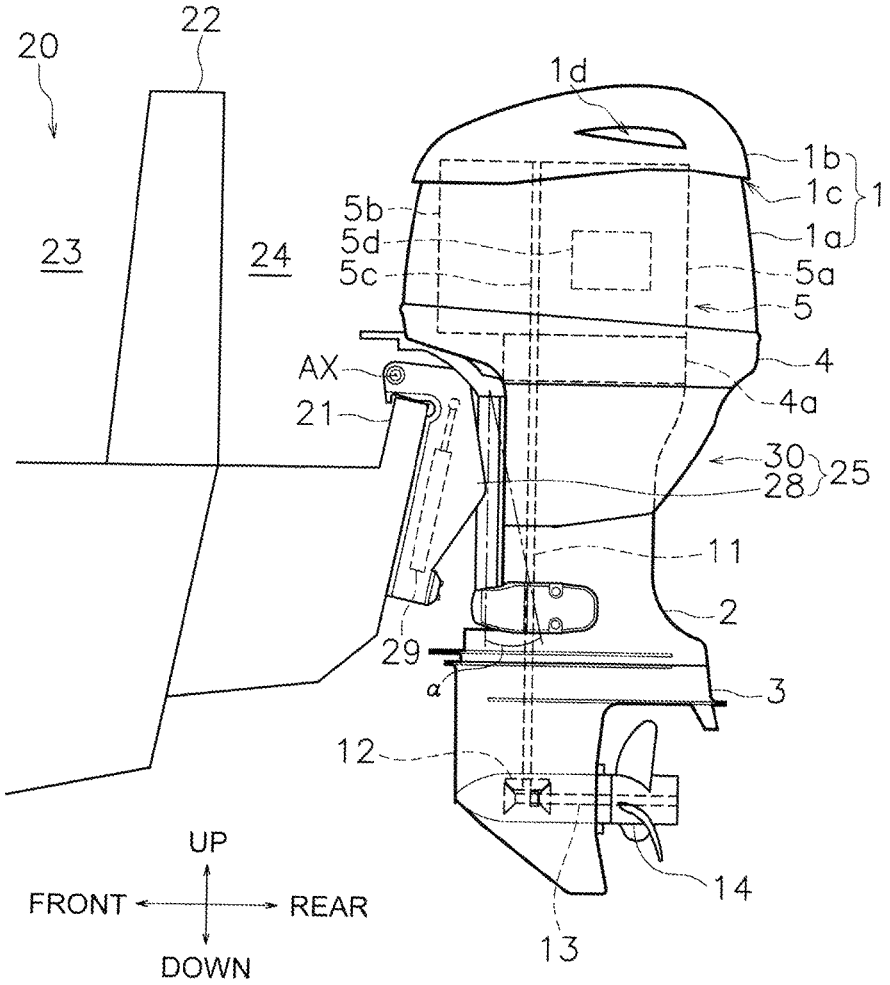
FIG. 1 is a side view of an outboard motor disposed in a tilt-down position.
Figure 2:
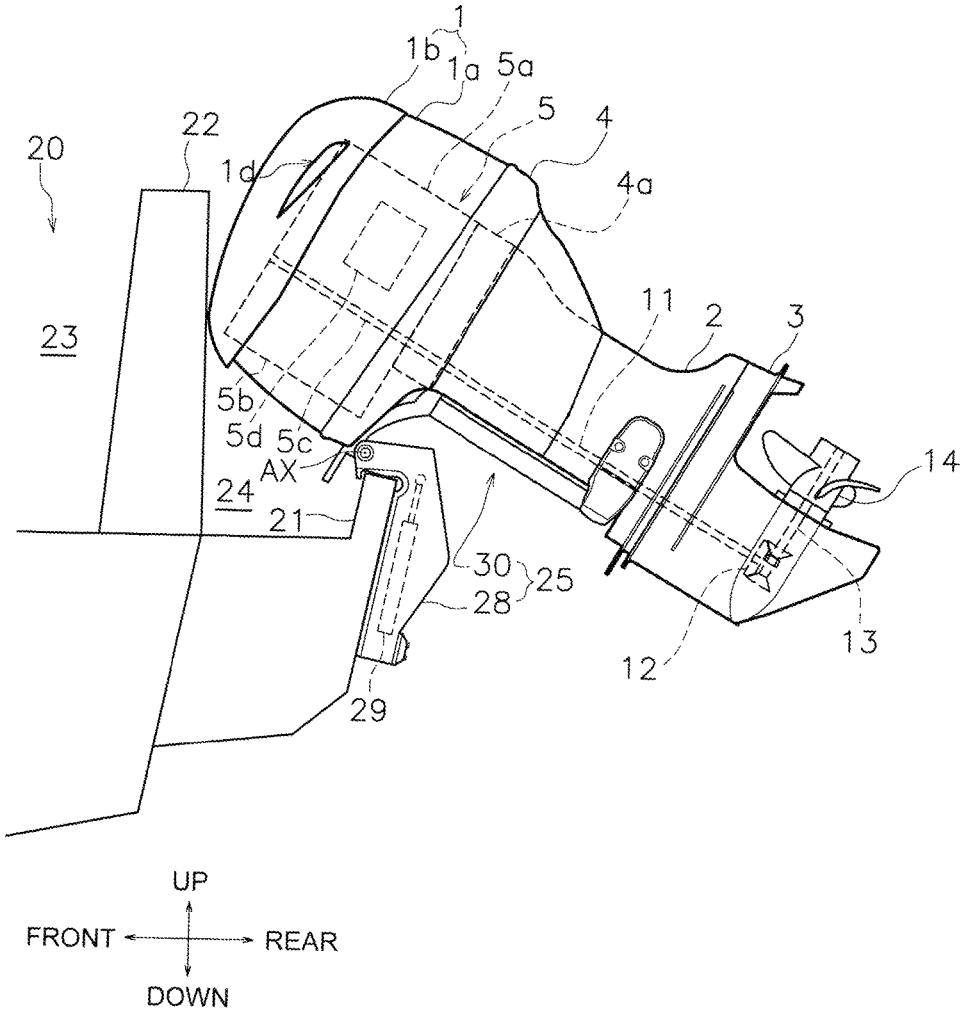
FIG. 2 is a side view of the outboard motor disposed in a tilt-up position.

A watercraft 10 according to preferred embodiments of the present invention will be explained below. FIGS. 1 and 2 are side views of a rear end of the watercraft 10 and its surroundings. FIG. 1 shows an outboard motor 30 disposed in a tilt-down position. FIG. 2 shows the outboard motor 30 disposed in a tilt-up position.

The watercraft 10 includes a hull 20 and a marine propulsion device 25.

The hull 20 includes a transom 21 and a rear wall 22. The transom 21 is located at the stern of the hull 20. The transom 21 is a portion of the hull 20 and protrudes upward from the rear end of the bottom of the hull 20. The rear wall 22 is located forward of the transom 21. The rear wall 22 is a portion of the hull 20 and protrudes upward from the rear end of a deck. The rear wall 22 may be provided with a tank to hold, for example, fish in its interior. A deck space 23 that allows the crew to board is located forward of the rear wall 22. A motor well 24 in which the outboard motor 30 is disposed is located rearward of the rear wall 22.

The marine propulsion device 25 includes a bracket 28, a PTT (power tilt and trim) device 29 and the outboard motor 30. The bracket 28 is attached to the transom 21 of the hull 20. The bracket 28 supports the outboard motor 30 such that the outboard motor 30 is able to pivot in the right-and-left direction and the up-and-down direction.

The PTT device 29 pivots the outboard motor 30 in the up-and-down direction about a tilt axis AX extending in the horizontal direction. The PTT device 29 pivots the outboard motor 30 including a cowl 1 (to be described below) from the tilt-down position (see FIG. 1) to the tilt-up position (see FIG. 2). The PTT device 29 is an example of a "tilt mechanism".

In the present preferred embodiment, the tilt-up position indicates a positional range in which half or more of a propeller 14 (to be described below) is located above the surface of the water. Specifically, the tilt-up position is preferably in a range within, for example, about 30 degrees forward from the maximum tilt angle, or in a range that a tilt angle $\alpha$ is greater than, for example, about 45 degrees. On the other hand, the tilt-down position is a range in which more than half of the propeller 14 is immersed under the surface of the water. Specifically, the tilt-down position is preferably in a range within, for example, about 20 degrees rearward from the minimum trim angle, or in a range that the tilt angle $\alpha$ is less than or equal to about 45 degrees. It should be noted that as shown in FIG. 1, the tilt angle $\alpha$ is an angle defined by a drive shaft 11 (to be described below) relative to the up-and-down direction. The maximum tilt angle is an angle defined by a drive shaft 11 relative to the up-and-down direction when a tilt cylinder (not shown) is maximized while mooring and so on. The minimum trim angle is an angle defined by a drive shaft 11 relative to the up-and-down direction when a trim cylinder (not shown) is minimized while navigating and so on.

In thrusting the hull 20, the PTT device 29 pivots the outboard motor 30 from the tilt-up position to the tilt-down position. When the outboard motor 30 is located in the tilt-down position, the PTT device 29 is able to suitably adjust the tilt angle α of the outboard motor 30.

When anchoring the hull 20, the PTT device 29 pivots the outboard motor 30 from the tilt-down position to the tilt-up position. Accordingly, it is possible to prevent the occurrence of galvanic corrosion of the outboard motor 30 and the attachment of algae to the outboard motor 30.

The outboard motor 30 is disposed in the motor well 24. The outboard motor 30 includes the cowl 1, an upper casing 2, a lower casing 3, a bottom cowl 4 and an engine unit 5. The cowl 1, the upper casing 2, the lower casing 3 and the bottom cowl 4 define a housing of the outboard motor 30. The cowl 1, the upper casing 2 and the engine unit 5 are attached to an exhaust guide 4*a* disposed in the interior of the bottom cowl 4.

The cowl 1 is located above the bottom cowl 4. The cowl 1 includes a stationary portion 1*a*, a movable portion 1*b* and an opening 1*c*.

The stationary portion 1*a* is disposed on and fixed to the bottom cowl 4. The stationary portion 1*a* covers the engine unit 5 from lateral sides of the engine unit 5.

The movable portion 1*b* is disposed on the stationary portion 1*a*. The movable portion 1*b* covers the stationary portion 1*a* from above. The movable portion 1*b* is movable relative to the stationary portion 1*a*. When the cowl 1 is pivoted from the tilt-down position to the tilt-up position, the movable portion 1*b* is moved from a normal position (see FIG. 1 and FIG. 3 to be described below) to a contracted position (see FIG. 2 and FIG. 4 to be described below) so as to shrink or reduce the contour of the cowl 1. With this structure, the rear wall 22 is shifted rearward by reducing the size of the motor well 24. In other words, the deck space 23 is expanded. The movable portion 1*b* may be moved from the normal position to the contracted position when the cowl 1 is located in the tilt-down position, or alternatively, during movement of the cowl 1 from the tilt-down position to the tilt-up position.

When the cowl 1 is located in the tilt-up position, the movable portion 1*b* is located at the forward end of the cowl 1. When the cowl 1 is located in the tilt-up position, the movable portion 1*b* faces the rear wall 22. The movable portion 1*b* is the most forward portion of the cowl 1 when the cowl 1 is tilted up. The movable portion 1*b* is also located closest to the rear wall 22 when the cowl 1 is tilted up. When the cowl 1 is located in the tilt-down position, the contracted position of the movable portion 1*b* is located below the normal position of the movable portion 1*b* in the vertical direction. The movable portion 1*b* includes air inlets 1*d* in both lateral portions in order to take in outside air.

Figure 3:
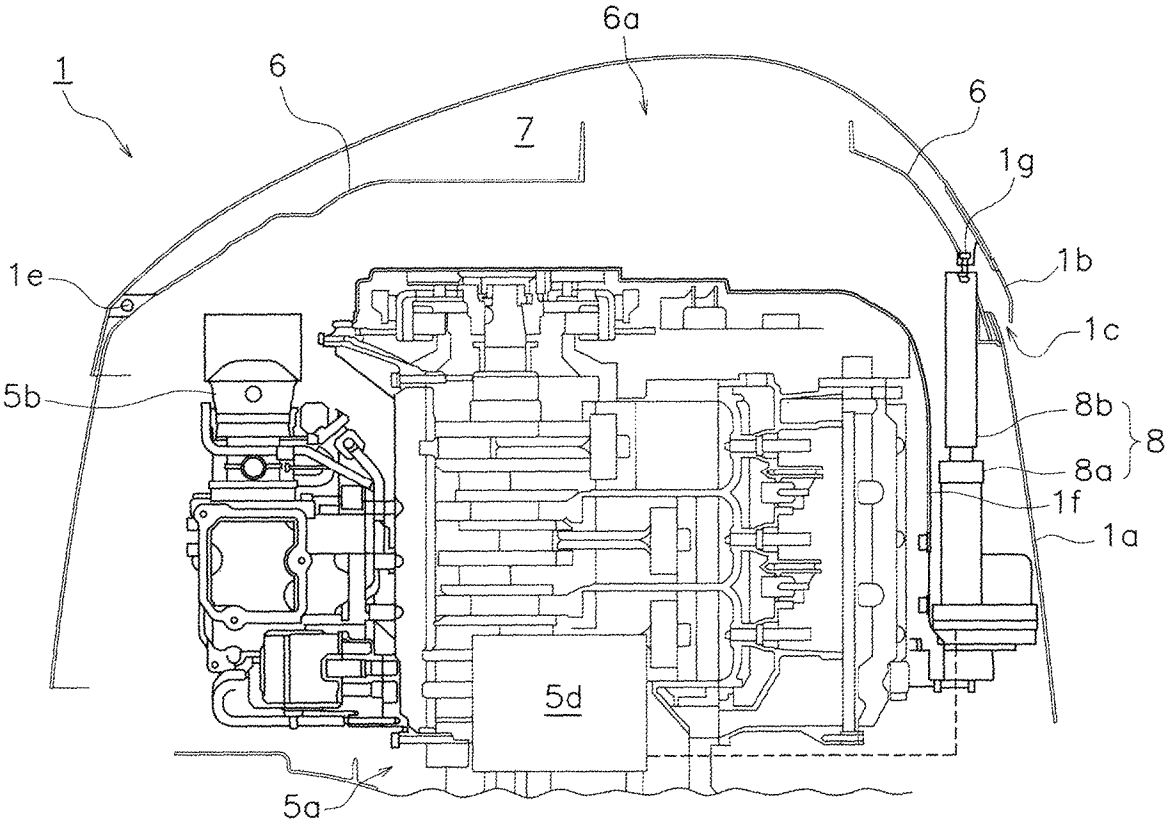
FIG. 3 is a cross-sectional view of a movable portion disposed in a normal position.
Figure 4:
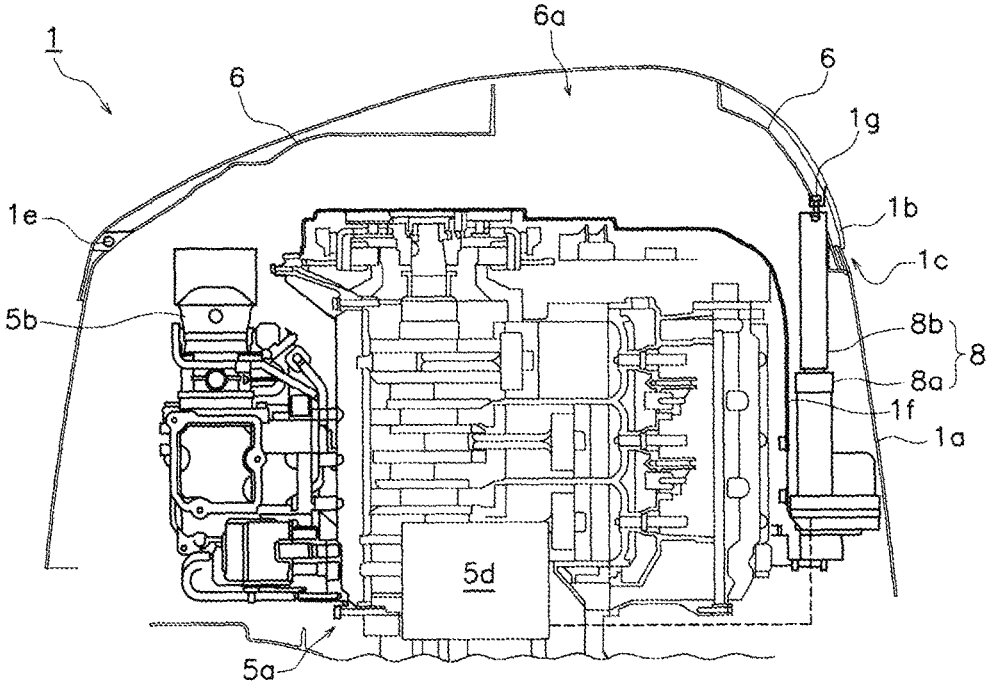
FIG. 4 is a cross-sectional view of the movable portion disposed in a contracted position.

The opening 1*c* is located on the rear end of the cowl 1. The opening 1*c* opens rearward. The opening 1*c* is a gap between the upper portion of the rear end of the stationary portion 1*a* and the lower portion of the rear end of the movable portion 1*b*. As shown in FIGS. 1 and 3, when the movable portion 1*b* is located in the normal position, the opening 1*c* is open. As shown in FIGS. 2 and 4, when the movable portion 1*b* is located in the contracted position, the opening 1*c* is closed.

The upper casing 2 is located below the bottom cowl 4. The lower casing 3 is located below the upper casing 2.

The engine unit 5 is disposed in the interior of the cowl 1. The engine unit 5 includes an engine 5*a*, a throttle body 5*b*, a crankshaft 5*c* and an ECU (electric control unit) 5*d*. The engine 5*a* is preferably an internal combustion engine that burns fuel to generate a driving force. The throttle body 5*b* takes in air from outside and supplies the taken-in air to the engine 5*a*. The crankshaft 5*c* extends in the vertical direction. The ECU 5*d* is configured or programmed to control the PTT device 29. When a vessel operator presses a tilt-down button (not shown in the drawings) and simultaneously a predetermined condition is satisfied, the ECU 5*d* is configured or programmed to control and cause the PTT device 29 to pivot the outboard motor 30 from the tilt-up position to the tilt-down position. When the vessel operator presses a tilt-up button (not shown in the drawings) and simultaneously a predetermined condition is satisfied, the ECU 5*d* is configured or programmed to control and cause the PTT device 29 to pivot the outboard motor 30 from the tilt-down position to the tilt-up position. Controlling the PTT device 29 by the ECU 5*d* will be described below.

As shown in FIG. 1, the outboard motor 30 further includes the drive shaft 11, a bevel gear 12, a propeller shaft 13 and the propeller 14.

The drive shaft 11 extends in the vertical direction in the interiors of the upper casing 2 and the lower casing 3. The upper end of the drive shaft 11 is coupled to the lower end of the crankshaft 5*c*. The lower end of the drive shaft 11 is coupled to the front end of the propeller shaft 13 through the bevel gear 12. The propeller shaft 13 extends in the front-and-rear direction in the interior of the lower casing 3. The rear end of the propeller shaft 13 protrudes from the lower casing 3 and is coupled to the propeller 14. The propeller 14 is rotated together with the propeller shaft 13.

Next, an internal structure of the cowl 1 will be explained. FIGS. 3 and 4 are cross-sectional diagrams schematically showing the internal structure of the cowl 1. FIG. 3 shows the movable portion 1*b* disposed in the normal position. FIG. 4 shows the movable portion 1*b* disposed in the contracted position.

The outboard motor 30 includes an engine cover 6 disposed in the interior of the cowl 1. The engine cover 6 is connected to the upper end of the stationary portion 1*a* and defines a portion of the cowl 1. The engine cover 6 covers the engine unit 5 from above.

An intake pathway 7 is provided between the engine cover 6 and the movable portion 1*b* in order to supply air to the engine 5*a* therethrough. The engine cover 6 includes an intake port 6*a* that opens in the intake pathway 7. The outside air, flowing into the intake pathway 7 through the pair of the air inlets 1*d* (see FIG. 1) provided in the movable portion 1*b*, flows through the intake pathway 7 and flows into the interior of the stationary portion 1*a* through the intake port 6*a*. The air, flowing into the interior of the stationary portion 1*a*, is taken into the engine 5*a* through the throttle body 5*b*.

The outboard motor 30 includes an actuator 8 disposed inside the cowl 1. The actuator 8 is preferably located rearward of the engine 5*a*. The actuator 8 is preferably disposed in a gap between the stationary portion 1*a* and the engine 5*a*. The actuator 8 includes a body 8*a* and a driven portion 8*b*. The body 8*a* is fixed to a rear plate if that covers the engine 5*a* from behind. The body 8*a* is electrically connected to the ECU 5*d*. The lower end of the driven portion 8*b* is coupled to the body 8*a*. The upper end of the driven portion 8*b* is inserted through the engine cover 6, and is coupled to the rear end of the movable portion 1*b* by, for example, a bolt 1*g*. The driven portion 8*b* extends and contracts along the vertical direction. When the cowl 1 is pivoted from the tilt-down position to the tilt-up position, the actuator 8 contracts the driven portion 8*b* such that the movable portion 1*b* is moved from the normal position to the contracted position. When the cowl 1 is pivoted from the tilt-up position to the tilt-down position, the actuator 8 extends the driven portion 8*b* such that the movable portion 1*b* is moved from the contracted position to the normal position.

The ECU 5*d* is configured or programmed to control the actuator 8. When the vessel operator presses the tilt-up button and simultaneously a predetermined condition is satisfied, the ECU 5*d* is configured or programmed to contract the actuator 8 such that the movable portion 1*b* is moved from the normal position (see FIG. 3) to the contracted position (see FIG. 4). When the vessel operator presses the tilt-down button and simultaneously a predetermined condition is satisfied, the ECU 5*d* is configured or programmed to extend the actuator 8 such that the movable portion 1*b* is moved from the contracted position to the normal position. The ECU 5*d* is an example of an "actuator controller". Controlling the actuator 8 by the ECU 5*d* will be described below.

The movable portion 1*b* pivots downward about a pivot axis 1*e* when moving from the normal position to the contracted position. At this time, the movable portion 1*b* approaches the engine cover 6. Therefore, the movable portion 1*b* is located closer to the engine cover 6 when in the contracted position than when in the normal position. The movable portion 1*b* pivots upward about the pivot axis 1*e* when moving from the contracted position to the normal position. The pivot axis 1*e* is located forward of the opening 1*c*. The pivot axis 1*e* is mounted to the front end of the movable portion 1*b*. The pivot axis 1*e* extends in the horizontal direction.

Figure 5:
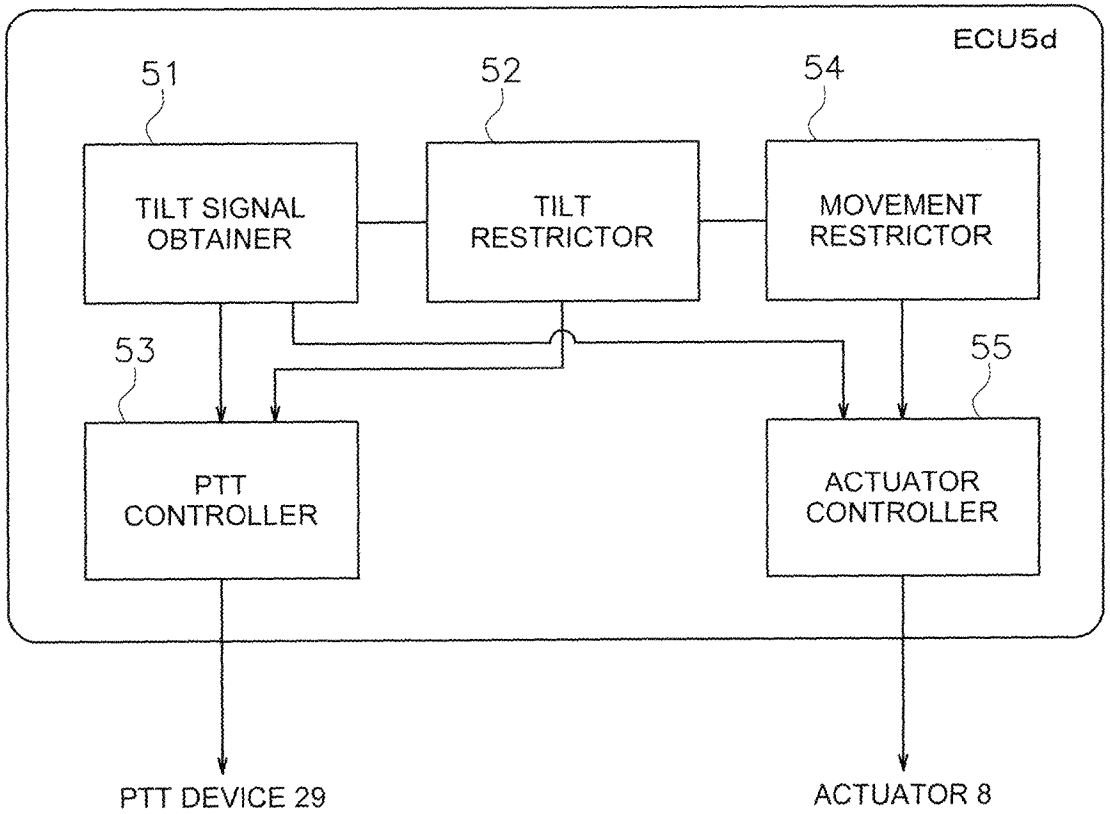
FIG. 5 is a block diagram of a functional configuration of an ECU.

FIG. 5 is a block diagram of a functional configuration of the ECU 5*d*. The ECU 5*d* includes a tilt signal obtainer 51, a tilt restrictor 52, a PTT controller 53, a movement restrictor 54 and an actuator controller 55.

The tilt signal obtainer 51 obtains a tilt-down command signal and a tilt-up command signal. The tilt-down command signal is outputted in response to pressing the tilt-down button by the vessel operator, whereas the tilt-up command signal is outputted in response to pressing the tilt-up button by the vessel operator. The tilt signal obtainer 51 outputs either the tilt-down command signal or the tilt-up command signal to the PTT controller 53.

The tilt restrictor 52 allows or prevents pivoting of the cowl 1. The tilt restrictor 52 allows pivot of the cowl 1 from the tilt-down position to the tilt-up position when the cowl 1 is located in the tilt-down position (see FIG. 1) and simultaneously when either the engine 5*a* is stopped or a transmission (not shown in the drawings) coupled to the engine 5*a* is in a neutral state. The tilt restrictor 52 prevents pivoting of the cowl 1 from the tilt-down position to the tilt-up position when the cowl 1 is located in the tilt-down position and simultaneously when either the engine 5*a* is being driven or the transmission coupled to the engine 5*a* is in either a forward thrust state or a backward thrust state. The tilt restrictor 52 informs each of the PTT controller 53 and the movement restrictor 54 of an allowed/prevented state of pivoting of the cowl 1.

The PTT controller 53 is configured or programmed to control and cause the PTT device 29 to pivot the cowl 1 from the tilt-up position to the tilt-down position when the tilt-down command signal has been inputted to the PTT controller 53 from the tilt signal obtainer 51. The PTT controller 53 is configured or programmed to control and cause the PTT device 29 to pivot the cowl 1 from the tilt-down position to the tilt-up position when the tilt-up command signal has been inputted to the PTT controller 53 from the tilt signal obtainer 51 and simultaneously the tilt restrictor 52 has informed the PTT controller 53 to allow pivoting of the cowl 1. The PTT controller 53 is configured or programmed not to control the PTT device 29 when the tilt-up command signal has been inputted into the PTT controller 53 from the tilt signal obtainer 51 and simultaneously the tilt restrictor 52 has informed the PTT controller 53 to prevent pivoting of the cowl 1.

The movement restrictor 54 allows or prevents movement of the movable portion 1*b* in accordance with the pivot state of the cowl 1 being allowed or prevented by the tilt restrictor 52. The movement restrictor 54 prevents movement of the movable portion 1*b* from the normal position (see FIG. 3) to the contracted position (see FIG. 4) when the tilt restrictor 52 prevents pivoting of the cowl 1 from the tilt-down position to the tilt-up position. The movement restrictor 54 allows movement of the movable portion 1*b* from the normal position to the contracted position when the tilt restrictor 52 allows the cowl 1 to pivot from the tilt-down position to the tilt-up position.

The actuator controller 55 is configured or programmed to control and cause the actuator 8 to move the movable portion 1*b* from the contracted position to the normal position when the tilt-down command signal has been inputted to the actuator controller 55 from the tilt signal obtainer 51. The actuator controller 55 is configured or programmed to control and cause the actuator 8 to move the movable portion 1*b* from the normal position to the contracted position when the tilt-up command signal has been inputted to the actuator controller 55 from the tilt signal obtainer 51 and simultaneously the movement restrictor 54 has informed the actuator controller 55 to allow movement of the movable portion 1*b*. The actuator controller 55 is configured or programmed not to control the actuator 8 when the tilt-up command signal has been inputted to the actuator controller 55 from the tilt signal obtainer 51 and simultaneously the movement restrictor 54 has informed the actuator controller 5 to prevent movement of the movable portion 1*b*.

Preferred embodiments of the present invention have been described above. However, the present invention is not limited to the above preferred embodiments, and a variety of changes can be made without departing from the scope of the present invention.

In the above preferred embodiments, the outboard motor 30 preferably includes the actuator 8 to move the movable portion 1*b*. However, the outboard motor 30 may not include the actuator 8. This is able to be achieved when the movable portion 1*b* is manually movable from the normal position to the contracted position.

Figure 6:
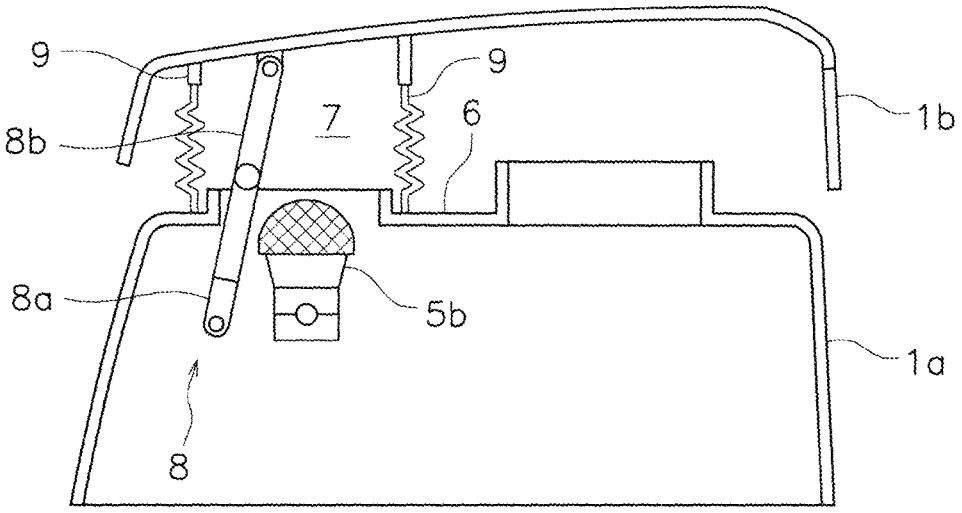
FIG. 6 is a schematic diagram of a positional arrangement of an actuator.

In the above preferred embodiments, the actuator 8 is preferably located rearward of the engine 5*a*. However, the positional arrangement of the actuator 8 is not limited to this. As shown in FIG. 6, the actuator 8 may be located forward of the engine 5*a*. In this case, the intake pathway 7 and the throttle body 5*b* are secluded by disposing the driven portion 8*b* of the actuator 8 inside an extension/contraction member 9 joined to both of the movable portion 1*b* and the engine cover 6. Alternatively, the actuator 8 may be disposed above or laterally to a side of the engine 5*a*, or may be disposed inside the intake pathway 7. By disposing the actuator 8 forward of or laterally to the engine 5*a* or in the intake pathway 7, the moving distance of the movable portion 1*b* when extending and contracting the actuator 8 is increased.

In the above preferred embodiments, the upper end of the driven portion 8*b* of the actuator 8 is preferably coupled to the movable portion 1*b* of the cowl 1 by the bolt 1*g*. However, the coupling of the upper end of the driven portion 8*b* to the movable portion 1*b* is not limited to this. The upper end of the driven portion 8*b* of the actuator 8 may be coupled to the movable portion 1*b* through a joint that is easily attachable thereto and detachable therefrom. Alternatively, the upper end of the driven portion 8*b* may only make contact with the movable portion 1*b*. These structures enable smooth attachment/detachment of the movable portion 1*b* of the cowl 1.

In the above preferred embodiments, the driven portion 8*b* of the actuator 8 is preferably coupled to the body 8*a*. However, the driven portion 8*b* may be attached to the body 8*a* so as to be easily detachable therefrom. This structure enables smooth attachment/detachment of the movable portion 1*b* of the cowl 1.

Figure 7:
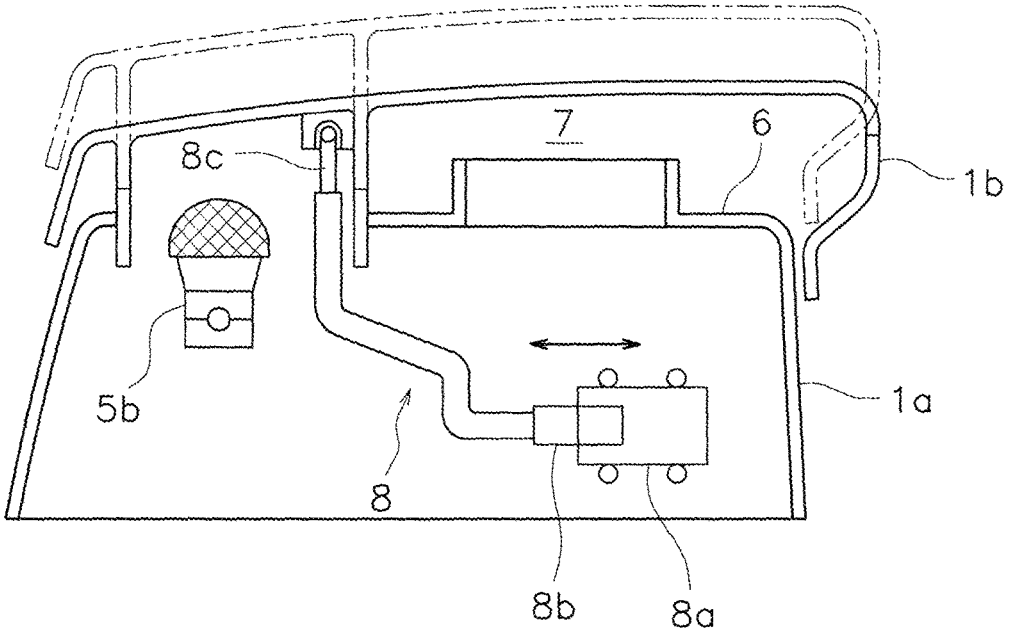
FIG. 7 is a schematic diagram of a positional arrangement of an actuator.
Figure 8:
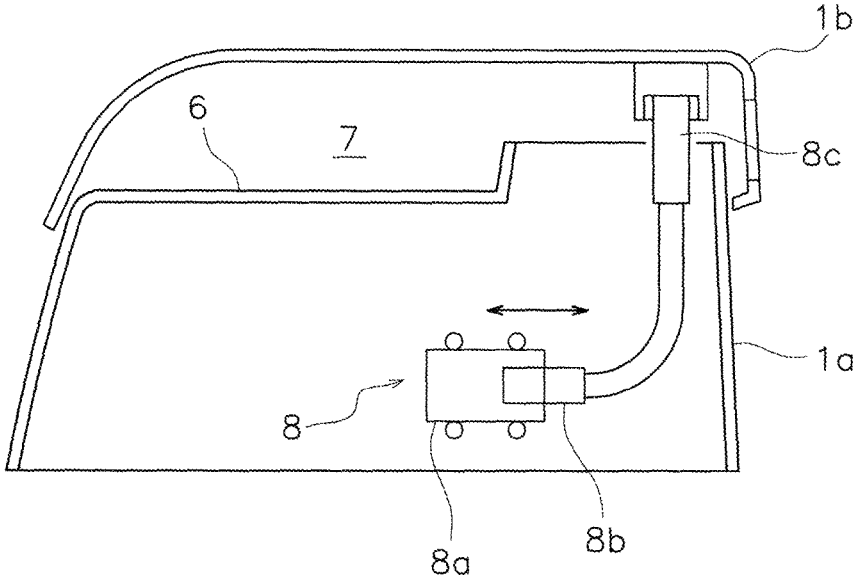
FIG. 8 is a schematic diagram of a positional arrangement of an actuator.

In the above preferred embodiments, the driven portion 8*b* of the actuator 8 is preferably directly coupled to the movable portion 1*b*. However, the coupling of the actuator 8 to the movable portion 1*b* is not limited to this. As shown in FIGS. 7 and 8, the actuator 8 may include a cable 8*c* connected to both of the driven portion 8*b* and the movable portion 1*b*. This structure enables the actuator 8 to be located in a desirable location.

Figure 9:
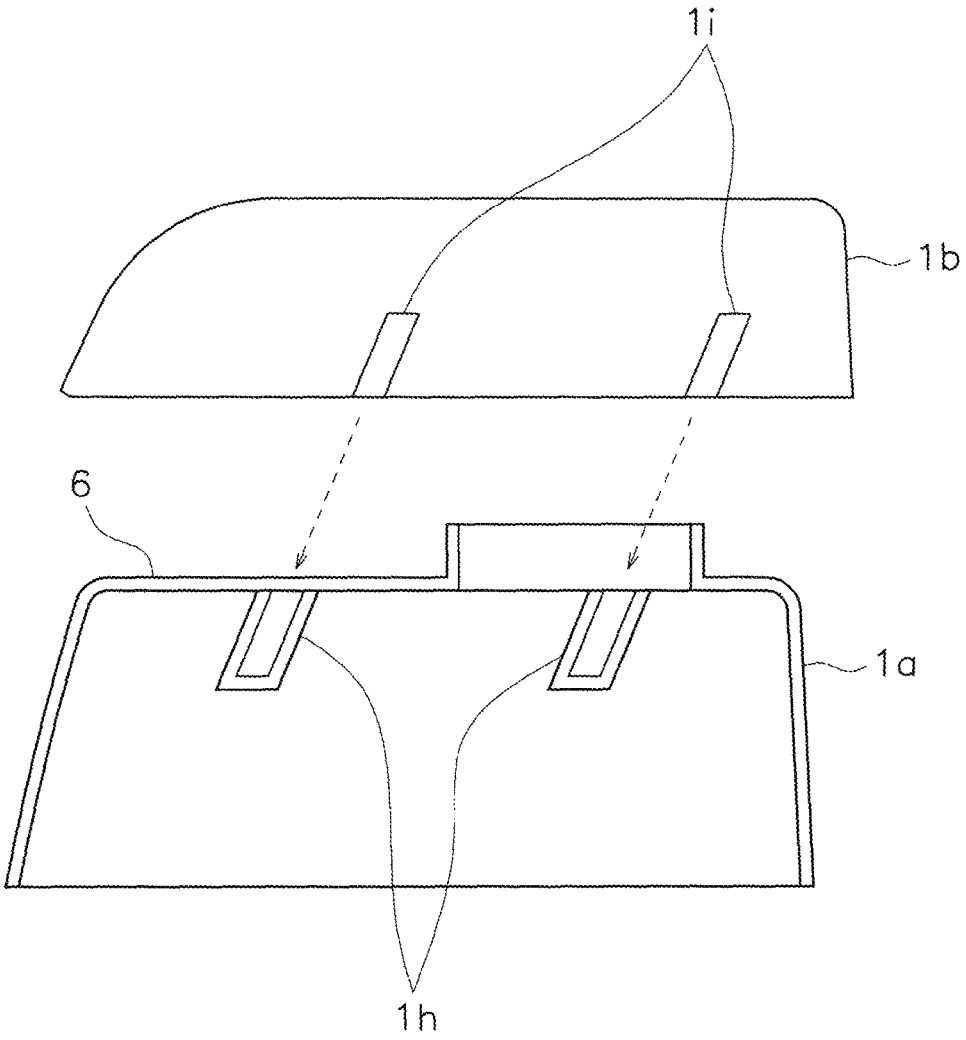
FIG. 9 is a schematic diagram of a cowl according to another preferred embodiment of the present invention.

In the above preferred embodiments, the movable portion 1*b* of the cowl 1 is preferably able to pivot up and down about the pivot axis 1*e*. However, as shown in FIGS. 6 to 8, the movable portion 1*b* may move up and down. In this configuration, as shown in FIG. 9, it is preferable to provide the outer peripheral surface of the stationary portion 1*a* with at least one guide rail 1*h* and provide the inner peripheral surface of the movable portion 1*b* with at least one guide portion 1*i*. This structure provides smooth movement of the movable portion 1*b*. It should be noted that the outer peripheral surface of the stationary portion 1*a* may be provided with the at least one guide portion 1*i* whereas the inner peripheral surface of the movable portion 1*b* may be provided with the at least one guide rail 1*h*.

Figure 10:
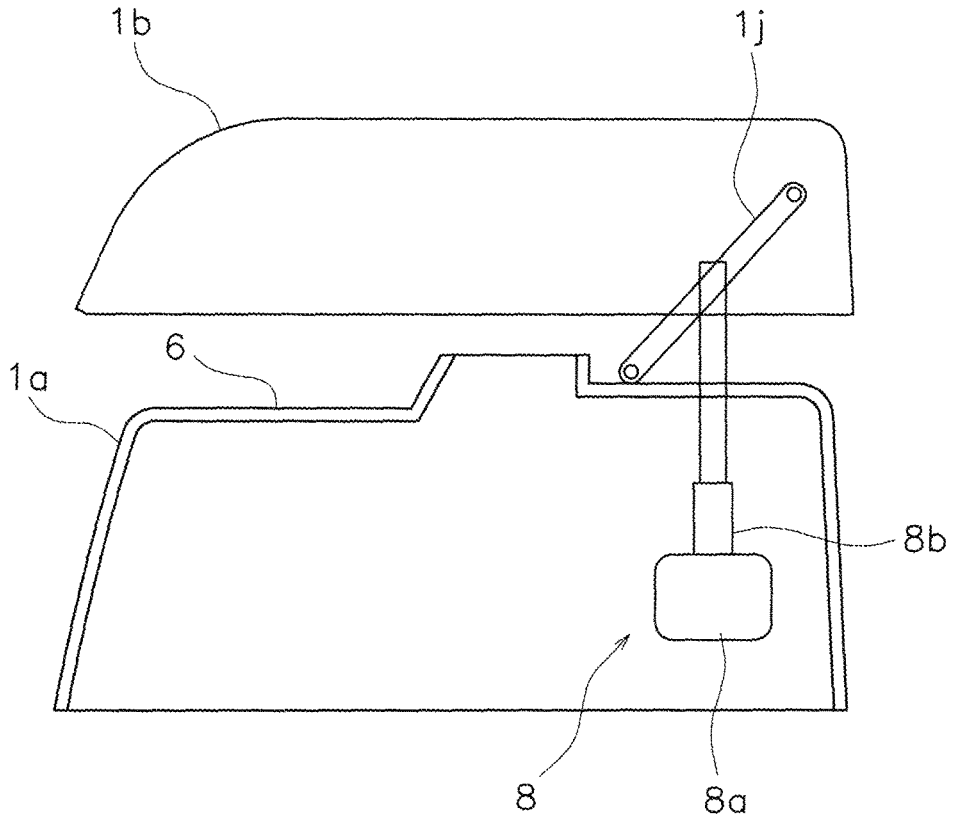
FIG. 10 is a schematic diagram of a cowl according to another preferred embodiment of the present invention.

In the above preferred embodiments, the driven portion 8*b* of the actuator 8 is preferably directly coupled to the movable portion 1*b*. However, as shown in FIG. 10, the driven portion 8*b* may be coupled to a coupling member 1*j* that is coupled to both of the movable portion 1*b* and the engine cover 6 in a pivotable state. This structure extends the moving distance of the movable portion 1*b* when extending and contracting the actuator 8.

In the above preferred embodiments, the outboard motor 30 preferably includes the engine cover 6. However, the outboard motor 30 may not include the engine cover 6.

In the above preferred embodiments, the movable portion 1*b* is preferably movable to shrink or reduce the contour of the cowl 1. However, not only the movable portion 1*b* but also the stationary portion 1*a* may be moved to shrink or reduce the contour of the cowl 1. Alternatively, only the stationary portion 1*a* may be moved to shrink or reduce the contour of the cowl 1. In this structure, the stationary portion 1*a* is an example of a "first cowl portion", whereas the movable portion 1*b* is an example of a "second cowl portion".

In the above preferred embodiments, when the cowl 1 is pivoted from the tilt-down position to the tilt-up position, the movable portion 1*b* is preferably moved from the normal position to the contracted position so as to reduce the contour of the cowl 1. However, the structure to move the movable portion 1*b* is not limited to this. Regardless of whether or not the cowl 1 is pivoted from the tilt-down position to the tilt-up position, the movable portion 1*b* may be movable from the normal position to the contracted position so as to reduce the contour of the cowl 1. In this configuration, the height of the outboard motor 30 is reduced by reducing the contour of the cowl 1, and thus, rear visibility is ensured. Additionally, the power performance of the engine 5*a* is able to be regulated by changing the contour of the cowl 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a cowl accommodating the engine; and a tilt mechanism that pivots the cowl from a tilt-down position to a tilt-up position about a horizontal tilt axis; wherein the cowl includes a movable portion that is moved from a first position to a contracted position so as to reduce a contour of the cowl when the cowl is pivoted from the tilt-down position to the tilt-up position by the tilt mechanism.

2. The outboard motor according to claim 1, wherein the movable portion is located on a forward end of the cowl when the cowl is located in the tilt-up position.

3. The outboard motor according to claim 1, wherein the contracted position is located vertically below the first position.

4. The outboard motor according to claim 1, further comprising:

an engine cover disposed inside the cowl and covering the engine from above the engine; wherein the movable portion and the engine cover define an intake pathway to supply air to the engine.

5. The outboard motor according to claim 4, wherein the movable portion is located closer to the engine cover when the movable portion is located in the contracted position than when the movable portion is located in the first position.

6. The outboard motor according to claim 4, wherein the engine cover includes an intake port that opens to the intake pathway.

7. The outboard motor according to claim 1, further comprising:

an actuator that moves the movable portion from the first position to the contracted position when the cowl is pivoted from the tilt-down position to the tilt-up position.

8. The outboard motor according to claim 7, further comprising:

an engine cover disposed inside the cowl and covering the engine from above the engine; wherein the movable portion and the engine cover define an intake pathway to supply air to the engine; and the actuator is located in the intake pathway.

9. The outboard motor according to claim 7, further comprising:

an actuator controller configured or programmed to control and cause the actuator to move the movable portion from the first position to the contracted position when the cowl is pivoted from the tilt-down position to the tilt-up position.

10. The outboard motor according to claim 7, wherein the actuator includes a cable connected to the movable portion.

11. The outboard motor according to claim 1, wherein the cowl includes an opening that opens when the movable portion is located in the first position.

12. The outboard motor according to claim 11, wherein the opening opens rearward.

13. The outboard motor according to claim 12, wherein the movable portion pivots about a pivot axis located forward of the opening.

14. The outboard motor according to claim 11, wherein the opening is closed when the movable portion is located in the contracted position.

15. The outboard motor according to claim 1, wherein the cowl includes a guide rail, and the movable portion is moved from the first position to the contracted position along the guide rail.

16. The outboard motor according to claim 1, further comprising:

a tilt restrictor that allows or prevents pivoting of the cowl; and a movement restrictor that allows or prevents movement of the movable portion in accordance with a pivot state of the cowl being allowed or prevented by the tilt restrictor.

17. The outboard motor according to claim 16, wherein the movement restrictor prevents movement of the movable portion from the first position to the contracted position when the tilt restrictor prevents pivoting of the cowl from the tilt-down position to the tilt-up position.

18. The outboard motor according to claim 16, wherein the movement restrictor allows movement of the movable portion from the first position to the contracted position when the tilt restrictor allows pivoting of the cowl from the tilt-down position to the tilt-up position.

19. The outboard motor according to claim 16, wherein the tilt restrictor allows pivoting of the cowl from the tilt-down position to the tilt-up position when the engine is stopped or when a transmission coupled to the engine is in a neutral state.

20. An outboard motor comprising:

an engine;

a cowl accommodating the engine; and a tilt mechanism that pivots the cowl from a tilt-down position to a tilt-up position about a horizontal tilt axis; wherein the cowl includes a first cowl portion and a second cowl portion, the first cowl portion enclosing the engine from lateral sides, the second cowl portion disposed on the first cowl portion, and the second cowl portion covers the engine from above the engine; and at least the first cowl portion or the second cowl portion moves to reduce a contour of the cowl when the cowl is pivoted from the tilt-down position to the tilt-up position by the tilt mechanism.

* * * * *